US010979841B2

(12) United States Patent
Gu

(10) Patent No.: US 10,979,841 B2
(45) Date of Patent: Apr. 13, 2021

(54) SPEAKER

(71) Applicant: AAC Technologies Pte. Ltd., Singapore (SG)

(72) Inventor: Xiaojiang Gu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,149

(22) Filed: Jul. 28, 2019

(65) Prior Publication Data

US 2020/0045487 A1 Feb. 6, 2020

(30) Foreign Application Priority Data

Aug. 1, 2018 (CN) ..... 201821235539.5

(51) Int. Cl.
*H04R 31/00* (2006.01)
*H04R 9/06* (2006.01)
*H04R 9/02* (2006.01)

(52) U.S. Cl.
CPC ..... *H04R 31/006* (2013.01); *H04R 9/02* (2013.01); *H04R 9/06* (2013.01); *H04R 9/025* (2013.01); *H04R 2231/003* (2013.01); *H04R 2400/11* (2013.01)

(58) Field of Classification Search
CPC . H04R 9/02; H04R 9/025; H04R 9/06; H04R 2231/003; H04R 2499/11; H04R 31/006; H04R 2400/11
USPC ..... 381/398, 433
See application file for complete search history.

(56) References Cited

U.S. PATENT DOCUMENTS

2005/0111689 A1* 5/2005 True ..... H04R 31/006 381/423
2015/0365744 A1* 12/2015 Cai ..... H04R 9/06 381/412
2017/0374471 A1* 12/2017 Li ..... H04R 9/02

FOREIGN PATENT DOCUMENTS

CN 107547995 A * 1/2018

* cited by examiner

*Primary Examiner* — Jesse A Elbin
(74) *Attorney, Agent, or Firm* — W&G Law Group LLP

(57) ABSTRACT

The present invention discloses a speaker, including: a vibration system; a magnetic circuit system; a frame fixing the vibration system and the magnetic circuit system, and a front cover covering the frame. The frame includes a number of hot-melt posts and a number of step parts arranged abutting against the hot-melt posts. The front cover includes a number of positioning holes matching the hot-melt posts and a number of positioning grooves matching the step parts and hollowed at a side of the front cover adjacent to the frame. The positioning holes are received in the positioning grooves; the step parts are accommodated in the positioning grooves; and the hot-melt posts pass through the positioning holes.

5 Claims, 3 Drawing Sheets

SPEAKER

FIELD OF THE PRESENT DISCLOSURE

The present disclosure relates to the field of electromagnetic transducers, more particularly to a speaker used in a portable electronic device.

DESCRIPTION OF RELATED ART

Speakers are widely used in various electronic products in life and industry. Their performance directly affects the functions of the electronic products with the speakers. With the rapid development of portable electronic devices, people have higher and higher requirements for the acoustic performance of the speakers. The speaker generally comprises a vibration system, a magnetic circuit system, a frame fixing the vibration system and the magnetic circuit system, a front cover which holds the vibration system on the frame, a number of hot-melt posts arranged on the frame, and a number of positioning holes aligned with the hot-melt posts on the front cover which is connected with the positioning holes in match through the hot-melt posts to fix the vibration system on the frame.

The inventor of the invention finds the following problems in the related art: due to the limited internal space of the speaker, large-sized hot-melt posts cannot be arranged on the frame, resulting in insufficient hot-melt post strength, especially for the speaker with an insert on the front cover, the height of the plastic front cover is high, and the corresponding hot-melt post set on the frame is overlong, and therefore the hot-melt posts are easy to break during assembling, and the lateral force bearing capacity of the speaker is weak after assembling, which causes that the fixed structure of the vibration system is not stable enough but easy to fall off, and the reliability of the speaker or the loudspeaker with the speaker is affected. Thus, how to provide a speaker with high lateral force bearing capacity, stable structure and high reliability under the limited speaker size is an important technical problem to be solved urgently in the field.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby are only to explain the disclosure, not intended to limit the disclosure.

Figure 1:
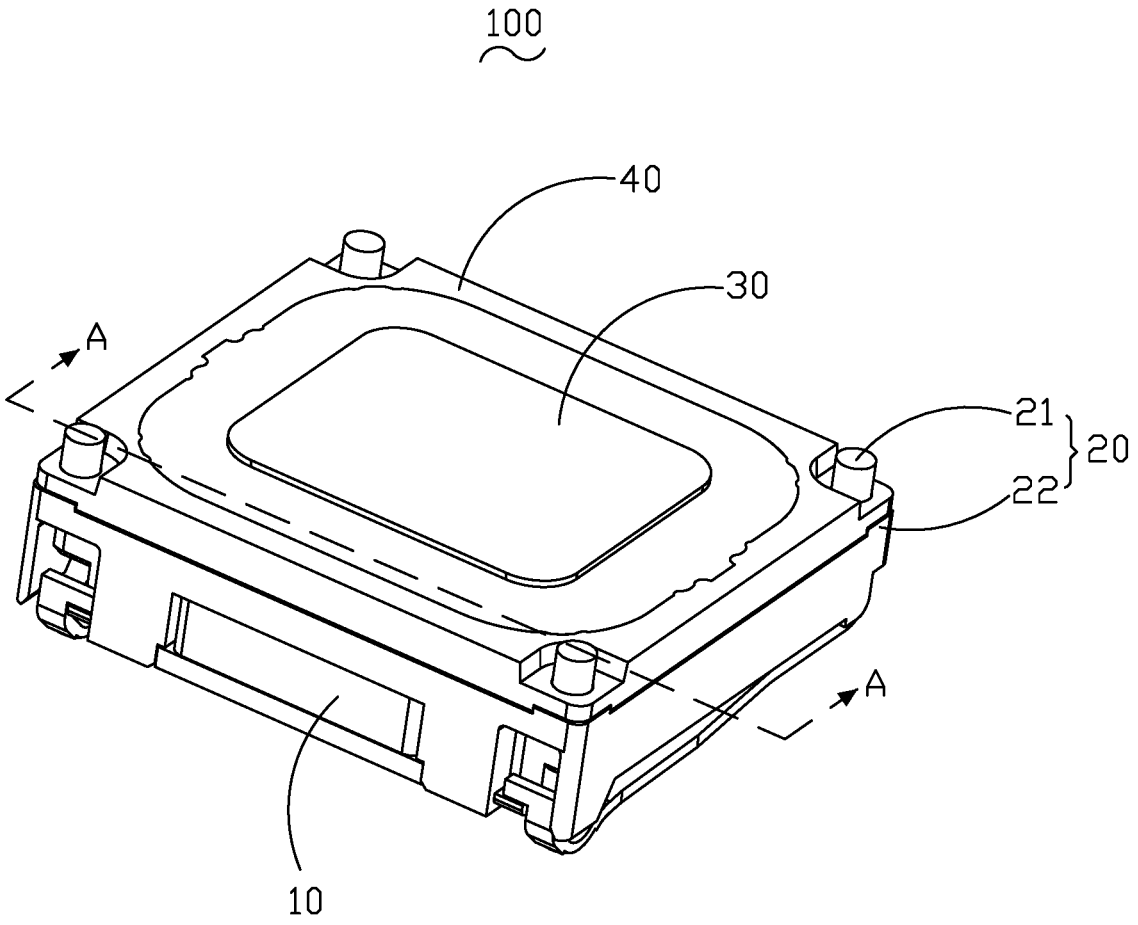
FIG. 1 is an isometric view of a speaker in accordance with an exemplary first exemplary embodiment of the present disclosure.
Figure 2:
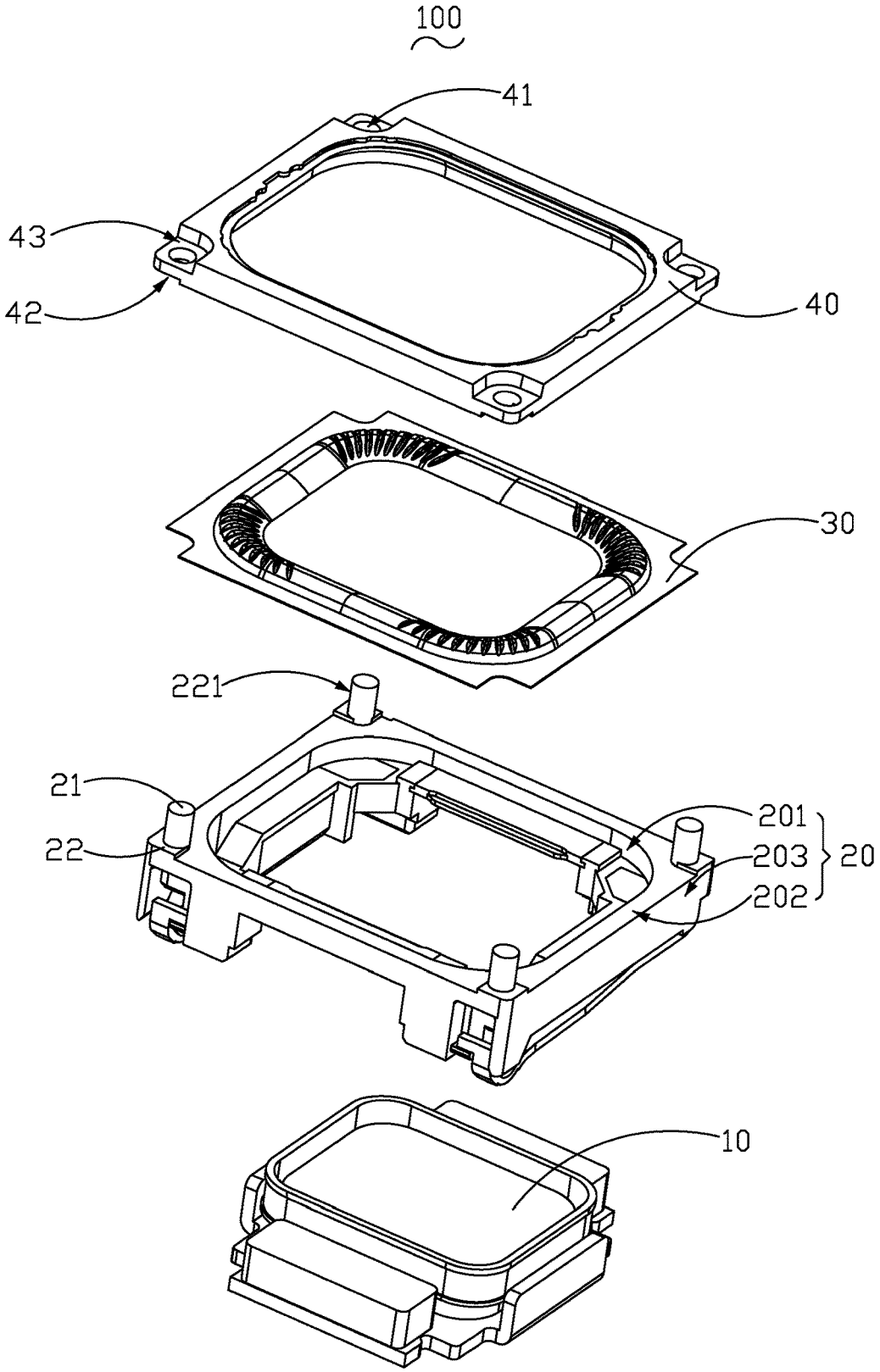
FIG. 2 is exploded view of the speaker in FIG. 1.
Figure 3:
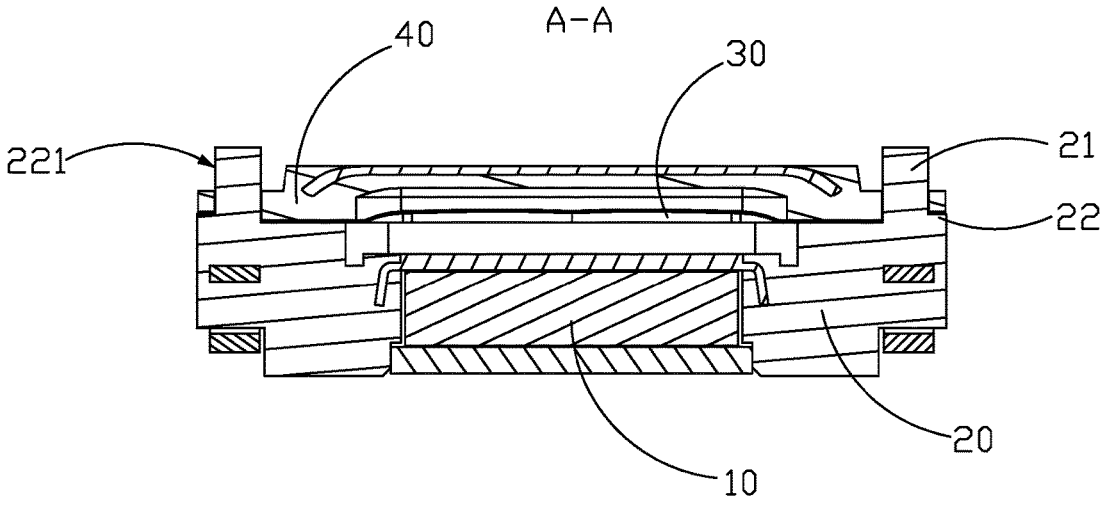
FIG. 3 is a cross-sectional view of the speaker in FIG. 1, taken along line A-A.
Figure 4:
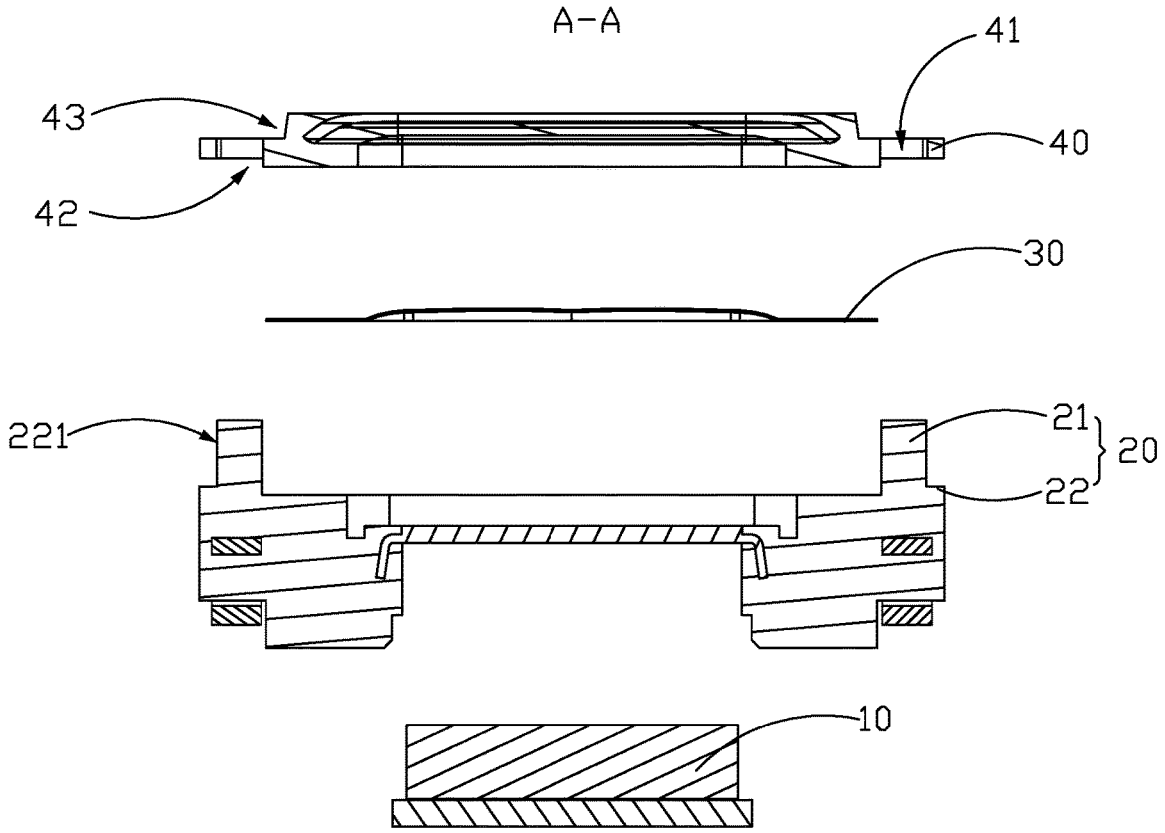
FIG. 4 is an exploded and cross-sectional view of the speaker.

A speaker 100, in accordance with an exemplary embodiment of the present invention as shown in FIGS. 1-4, includes a magnetic circuit system 10, a vibration system 30, a frame 20 fixing the vibration system 30 and the magnetic circuit system 10, a front cover 40 covering the frame 20, a plurality of hot-melt posts 21 arranged on the frame 20, a plurality of step parts 22 arranged at the periphery of the hot-melt posts 21 and abutting against the hot-melt posts 21, a plurality of through positioning holes 41 matching the hot-melt posts 21 are arranged on the front cover 40, and a plurality of positioning grooves 42 matching the step parts 22 and hollowed at the side of the front cover 40 close to the frame 20. The positioning holes 41 are in the positioning grooves 42, the step parts 22 are accommodated in the positioning grooves 42, and the hot-melt posts 21 pass through the positioning holes 41.

Compared with the related art, the frame 20 is provided with the hot-melt posts 21 and the step parts 22, and the front cover 40 is provided with the positioning holes 41 matching the hot-melt posts 21 and the positioning grooves 42 matching the step parts 22 to ensure the accurate positioning between the frame 20 and front cover 40 during assembling. The step parts 22 are arranged at the periphery of the hot-melt posts 21 to reduce the lateral force of the hot-melt posts 21 so as to enhance the lateral force bearing capacity of the speaker 100. In addition, the step parts 22 abut against the hot-melt posts 21 to strengthen the support for the hot-melt posts 21 so as to ensure that the hot-melt posts 21 are protected from being broken during assembling, further to prevent the vibration system 30 from disconnecting from the frame 20. Therefore the reliability of the speaker is improved.

Specifically, the magnetic circuit system 10 is used for providing a magnetic field and controls the vibration system 30 to vibrate to generate sounds. The vibration system 30 comprises a diaphragm and is used for radiating sounds.

The frame 20 comprises an inner side wall 201, an outer side wall 203 opposite to the inner side wall 201, and a top wall 202 connecting with the inner side wall 201 and the outer side wall 203 and abutting against the front cover 40. The hot-melt posts 21 and the step parts 22 all extend towards the front cover 40 from the top wall 202. The hot-melt posts 21 and the outer side wall 203 are set with intervals. The step parts 22 are arranged between the hot-melt posts 21 and the outer side wall 203.

When assembling, the hot-melt posts 21 pass through the positioning holes 41 in the front cover 40, and the step parts 22 and the positioning grooves 42 cooperate to clamp the vibration system 30 on the frame 20 so as to prevent the relative displacement between the vibration system 30 and the frame 20. The assembling process is simple. When assembling, the hot-melt posts 21 can be heated by ironing the point with a tool or infrared rays, etc., to partially melt and deform, and after cooling down, the deformed parts abut with the positioning holes 41 to prevent the vibration system 30 from disconnecting. For the reasons of cost, etc., in the embodiment, the hot-melt posts 21 are made of plastic. In specific application, the hot-melt posts 21 can also be made from other materials.

Preferably, the outer periphery 221 of the step parts 22 flushes with the outer side wall 203, which can thicken the step parts 22 in maximum. In the condition of the same size of the frame 20, the step parts 22 which flush with the outer side wall 203 are wider so as to maximize the cross section area of the positioning structure between the front cover 40 and the frame 20 and to make the structure of the speaker 100 be stable.

It can be understood that in the embodiment, the frame 20 is rectangular. In order to ensure the fixing reliability between the vibration system 30 and the frame 20, the four corners of the frame 20 are all provided with the step parts 22 and hot-melt posts 21. In addition, the frame 20 is made of a magnetic conductive metal material which can be the carbon steel with good magnetic conductivity and low cost so as to improve the saturation magnetization of the frame 20 and reduce the cost.

The front cover 40 comprises the positioning holes 41, the positioning grooves 42 and an accommodation slot 43 formed by the hollowed side of the front cover 40 deviating from the frame 20, wherein, the positioning holes 41 are located in the accommodation slot 43, which ensures the molten hot-melt posts 21 are accommodated in the accommodation slot 43 and prevents the molten hot-melt posts 21 from flowing everywhere or not form after cooling down to affect the stability of the speaker 100.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker, including:

a vibration system;

a magnetic circuit system;

a frame fixing the vibration system and the magnetic circuit system, including a plurality of hot-melt posts and a plurality of step parts arranged at periphery of the hot-melt posts and abutting against lateral side of the hot-melt posts;

a front cover covering the frame, including a plurality of positioning holes matching the hot-melt posts and a plurality of positioning grooves matching the step parts and hollowed at a side of the front cover adjacent to the frame; wherein the positioning holes are received in the positioning grooves; the step parts are accommodated in the positioning grooves; and the hot-melt posts pass through the positioning holes.

2. The speaker as described in claim 1, wherein the frame comprises an inner side wall, an outer side wall opposite to the inner side wall, and a top wall connecting with the inner side wall and the outer side wall and abutting against the front cover; the hot-melt posts and the step parts extend towards the front cover from the top wall; the hot-melt posts and the outer side wall are set with intervals; and the step parts are arranged between the hot-melt posts and the outer side wall.

3. The speaker as described in claim 2, wherein an outer periphery of the step parts is coplanar with the outer side wall.

4. The speaker as described in claim 1, wherein the front cover further comprises an accommodation slot formed by recessing from one side of the front cover away from the frame, and the positioning holes are located in the accommodation slot.

5. The speaker as described in claim 1, wherein the frame is rectangular, and four corners of the frame are provided with the step parts and the hot-melt posts.

* * * * *